US007764245B2

(12) United States Patent
Loyet

(10) Patent No.: US 7,764,245 B2
(45) Date of Patent: Jul. 27, 2010

(54) MULTI-BAND ANTENNA

(75) Inventor: Lowell Lee Loyet, Woodinville, WA (US)

(73) Assignee: Cingular Wireless II, LLC, Atlanta, GA (US)

( * ) Notice: Subject to any disclaimer, the term of this patent is extended or adjusted under 35 U.S.C. 154(b) by 628 days.

(21) Appl. No.: 11/424,614

(22) Filed: Jun. 16, 2006

(65) Prior Publication Data

US 2007/0290938 A1 Dec. 20, 2007

(51) Int. Cl.
*H01Q 9/28* (2006.01)
*H01Q 1/38* (2006.01)

(52) U.S. Cl. ..... 343/795; 343/700 MS

(58) Field of Classification Search ..... None
See application file for complete search history.

(56) References Cited

U.S. PATENT DOCUMENTS

| | | | | |
|---|---|---|---|---|
| 3,016,536 | A | 1/1962 | Fubini | |
| 5,592,185 | A | 1/1997 | Itabashi et al. | |
| 5,949,382 | A | 9/1999 | Quan | |
| 6,469,677 | B1 | 10/2002 | Schaffner | |
| 6,529,170 | B1 | 3/2003 | Nishizawa et al. | |
| 6,658,263 | B1 | 12/2003 | Ke et al. | |
| 6,734,828 | B2 | 5/2004 | Shor | |
| 6,747,605 | B2 * | 6/2004 | Lebaric et al. | 343/795 |
| 6,859,176 | B2 | 2/2005 | Choi | |
| 6,965,353 | B2 | 11/2005 | Shirosaka et al. | |
| 6,992,632 | B1 | 1/2006 | Mohuchy | |
| 7,181,175 | B2 | 2/2007 | Nimmo-Smith et al. | |
| 7,277,062 | B1 | 10/2007 | Loyet | |
| 7,394,437 | B1 * | 7/2008 | Loyet | 343/795 |
| 2001/0012788 | A1 | 8/2001 | Gammon | |
| 2002/0075906 | A1 | 6/2002 | Cole et al. | |
| 2004/0266485 | A1 | 12/2004 | Paramesh et al. | |
| 2005/0073456 | A1 | 4/2005 | Sievenpiper et al. | |
| 2005/0073465 | A1 * | 4/2005 | Olson | 343/795 |

(Continued)

FOREIGN PATENT DOCUMENTS

EP 0 809 319 A 11/1997

(Continued)

OTHER PUBLICATIONS

International Search Report dated Dec. 7, 2007 for PCT Application Serial No. PCT/US07/71413, 8 Pages.

(Continued)

*Primary Examiner*—Trinh V Dinh

(57) ABSTRACT

A multi-band antenna for use in a wireless communications network provides frequency support for different wireless technologies in a single structure. This substantially reduces installation costs and can be the only solution in limited space installation sites. In one instance, the multi-band antenna has two serial feedlines carrying respective anode and cathode components of RF signals. Each, comprising serial feedline is coupled to two or more different length dipole elements. Each dipole element of a given length attached to the first serial feedline has a corresponding dipole element of approximately equal length attached to the second serial feedline and oriented, with respect to the first dipole element so as to form a dipole. Thus, at least two dipoles of differing lengths are formed, enabling performance in two different bands by the antenna. The gain of the antenna for any particular band is determined by the number of dipoles corresponding to that band contained within the antenna.

16 Claims, 9 Drawing Sheets

U.S. PATENT DOCUMENTS

| | | | | |
|---|---|---|---|---|
| 2005/0093647 | A1 | 5/2005 | DeCormier et al. | |
| 2005/0197095 | A1 | 9/2005 | Nakamata et al. | |
| 2006/0068723 | A1 | 3/2006 | Khorram | |
| 2007/0008236 | A1* | 1/2007 | Tillery et al. | 343/797 |
| 2007/0063914 | A1 | 3/2007 | Becker | |

FOREIGN PATENT DOCUMENTS

| | | | |
|---|---|---|---|
| EP | 1 158 602 | A1 | 11/2001 |
| EP | 1 357 634 | A | 10/2003 |
| EP | 1 544 938 | A | 6/2005 |
| EP | 1 601 112 | A | 11/2005 |
| WO | 98/42040 | A | 9/1998 |
| WO | 2004036785 | A | 4/2004 |
| WO | 2006/058964 | A | 6/2006 |

OTHER PUBLICATIONS

Nortel Networks. "GSM 900/1800/1900 Univity GSM Base Transceiver Station eCell" (2002) Product Bulletin, 2 pages.
Katherin. "UMTS Antennas from the World's Largest Antenna Supplier" (1999) Product-Marketing, Mobile Communication Antennas, 4 pages.
Nokia. "Transmission Solution for Nokia Mobile Networks"(2000) Product Bulletin, 4 pages.
Katherin. "Technical Information and New Products: Cellular Systems" located at www.katherin.de/de/mca/techn-infos/download/9985654.pdf, last viewed Oct. 23, 2006, 16 pages.
International Search Report dated Dec. 7, 2007 for PCT Application Serial No. 07/71413 , 2 Pages.
International Search Report and Written Opinion for PCT Application No. PCT/US07/71415, mailed Sep. 30, 2008, 12 pages.
International Search Report dated Nov. 17, 2008 for PCT Application Serial No. US/07/71414, 2 pages.
OA dated May 27, 2009 for U.S. Appl. No. 11/424,639, 15 pages.
OA dated Nov. 18, 2008 for U.S. Appl. No. 11/424,639, 19 pages.
OA dated Jun. 22, 2007 for U.S. Appl. No. 11/424,664, 12 pages.
OA dated Nov. 9, 2007 for U.S. Appl. No. 11/843,673, 13 pages.
Supplementary European Search Report Dated May 8, 2009 for Application No. EP 07 84 0256, 8 pages.
Supplementary European Search Report Dated Oct. 15, 2009 for Application No. EP 07 84 5210, 8 pages.
European Search Report dated May 12, 2009 for Application No. EP 07 79 8675, 7 pages.
EP OA dated Jan. 13, 2010 for European Patent Application No. 07845210.9, 1 page.

* cited by examiner

MULTI-BAND ANTENNA

RELATED APPLICATIONS

This application is related to co-pending and co-assigned U.S. applications entitled "MULTI-RESONANT MICROSTRIP DIPOLE ANTENNA,", filed on Jun. 16, 2006 and assigned Ser. No. 11/424,664 and "MULTI-BAND RF COMBINER," filed on Jun. 16, 2006 and assigned Ser. No. 11/424,639. The above-noted applications are incorporated herein by reference.

BACKGROUND

Wireless telephones and other wireless devices have become almost the defacto standard for personal and business communications. This has increased the competition between wireless service providers to gain the largest possible market share. As the marketplace becomes saturated, the competition will become even tougher as the competitors fight to attract customers from other wireless service providers.

As part of the competition, it is necessary for each wireless service provider to stay abreast of technological innovations and offer their consumers the latest technology. However, not all consumers are prepared to switch their wireless devices as rapidly as technological innovations might dictate. The reasons for this are varied and may range from issues related to cost to an unwillingness to learn how to use a new device or satisfaction with their existing device.

However, certain technological innovations may require different antenna technologies in order to deliver service to the wireless customer. For example, although Wide Band Code Division Multiple Access (WCDMA) and Global System for Mobile communications (GSM) technologies typically operate on different frequencies, and they may require separate antennas, a wireless provider may have customers using both types of technologies. In many areas, simply leasing or buying new antenna space for the new technology may be economical. However, in many areas, particularly in urban areas, the cost of obtaining additional leases as well as zoning and other regulatory issues can make retaining old technologies while introducing new technologies cost prohibitive.

Thus, it is desirable to have an antenna capable of simultaneously radiating and receiving signals from both technologies (i.e., a multi-band antenna). One attempted solution is the Kathrein brand multi-band omni antenna which was developed for E911 Enhanced Observed Time Difference (EOTD) deployments to measure adjacent cell sites downlink messaging for determining a mobile location. However, the Kathrein brand antenna design has limited RF performance due to its unique antenna element design which limits gain to unity.

SUMMARY

The following presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

The subject matter provides a multi-band antenna for use, for example, in a wireless communications network. Instances of the multi-band antenna provide frequency support for different wireless technologies in a single structure. This substantially reduces installation costs and can be the only solution in limited space installation sites. In one instance, the multi-band antenna has two serial feedlines carrying respective anode and cathode components of RF signals. Each serial feedline is coupled to two or more different length dipole elements. Each dipole element of a given length attached to the first serial feedline has a corresponding dipole element of approximately equal length attached to the second serial feedline and oriented, with respect to the first dipole element so as to form a dipole. Thus, at least two dipoles of differing lengths are formed, enabling performance in two different bands by the antenna. The gain of the antenna for any particular band is determined by the number of dipoles corresponding to that band contained within the antenna.

To the accomplishment of the foregoing and related ends, certain illustrative aspects of embodiments are described herein in connection with the following description and the annexed drawings. These aspects are indicative, however, of but a few of the various ways in which the principles of the subject matter may be employed, and the subject matter is intended to include all such aspects and their equivalents. Other advantages and novel features of the subject matter may become apparent from the following detailed description when considered in conjunction with the drawings.

DETAILED DESCRIPTION

Figure 1:
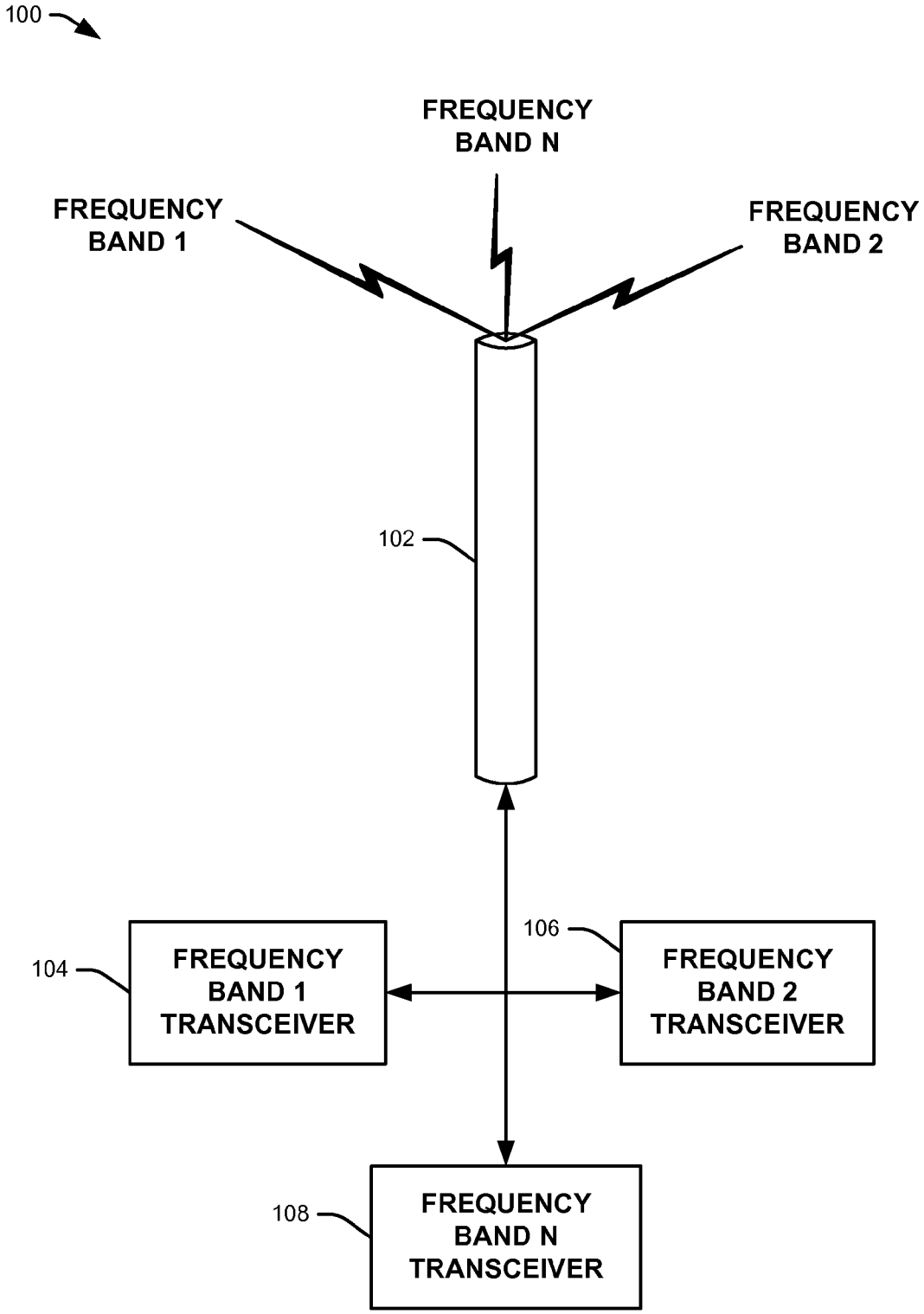
FIG. 1 is a block diagram of a multi-band antenna system in accordance with an aspect of an embodiment.

The subject matter is now described with reference to the drawings, wherein like reference numerals are used to refer to like elements throughout. In the following description, for purposes of explanation, numerous specific details are set forth in order to provide a thorough understanding of the subject matter. It may be evident, however, that subject matter embodiments may be practiced without these specific details. In other instances, well-known structures and devices are shown in block diagram form in order to facilitate describing the embodiments.

In FIG. 1, a block diagram of a multi-band antenna system 100 in accordance with an aspect of an embodiment is shown. The multi-band antenna system 100 is comprised of a multi-band antenna 102 that can transmit and/or receive multiple bands of frequencies from frequency band transceivers 1-N 104-108 that can receive and/or send frequency bands 1-N respectively, where N is an integer from one to infinity. In this manner, a single multi-band antenna 102 can replace multiple antennas that can only operate at a given frequency and/or can increase communication frequency bands when antenna installation space is limited. This provides a very cost effective and space effective alternative to multiple antenna installations.

Figure 2:
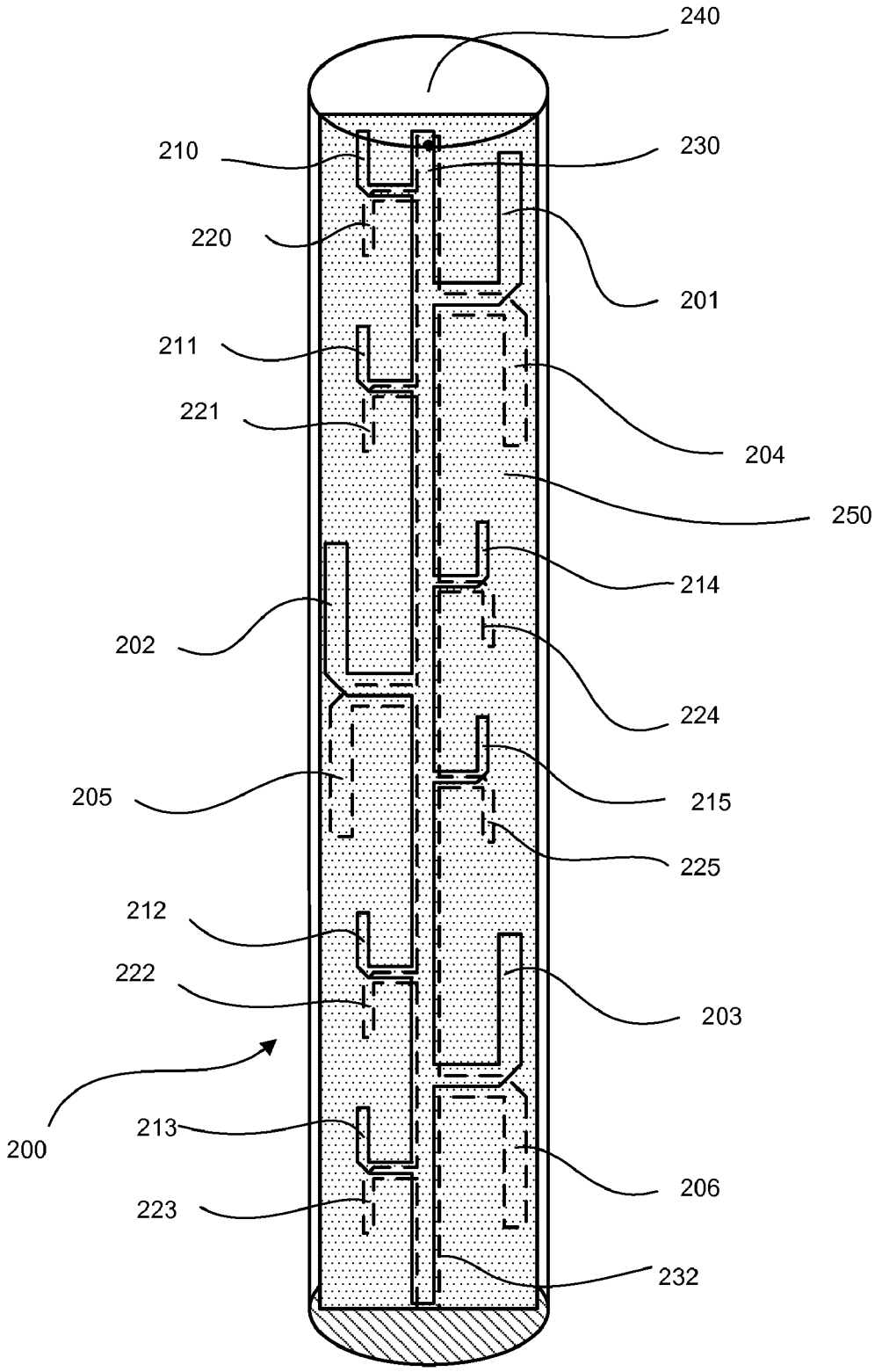
FIG. 2 is a side view of a multi-band antenna in accordance with an aspect of an embodiment.

Looking at FIG. 2, a side view of a multi-band antenna 200 in accordance with an aspect of an embodiment is illustrated. Multi-band antenna 200 can be implemented as, for example, one of the plurality of towers 930 depicted in FIG. 9. Multi-band antenna 200 is a microstrip multi-band collinear array with dipole elements 201-206, 210-215, and 220-225 arranged on both sides of microstrips 230 and 232 and on both sides of a dielectric substrate 250. The microstrips 230 and 232 and the dipole elements 201-206, 210-215, and 220-225 are constructed from an electrically conducting material (e.g., copper). The elements 201-203, 210-215, and 230 on a first side of the multi-band antenna 200 are illustrated with solid lines and the elements 204-206, 220-225, and 232 on the second side of the multi-band antenna separated from the first side by a dielectric substrate 250 are represented by dashed lines in FIG. 2.

The multi-band antenna 200 comprises large and small dipoles each of which corresponds to one of the bands of the antenna. The large dipoles comprise corresponding dipole elements 201 and 204, 202 and 205, and 203 and 206. The small dipoles comprise corresponding dipole elements 210 and 220, 211 and 221, 214 and 224, 215 and 225, 212 and 222, and 213 and 223. Each dipole contains a dipole element on the first side of the dielectric substrate 250 and a second dipole element on the second side of the dielectric substrate separated from each other by the dielectric substrate 250 such as, for example the dipole which contains a dipole element 201 on the first side of the dielectric substrate 250 and a dipole element 204 on the second side of the dielectric substrate 250. The dielectric substrate 250 can be any RF dielectric such as, for example, a PTFE (polytetrafluoroethylene)/fiberglass composite.

The two bands of operation from the multi-band antenna 200 can be, for example, cellular 850 MHz and PCS (personal communications service) 1900 MHz Frequency bands where the larger dipole elements, such as, for example, dipole element 201, radiate the 850 MHz signal and the smaller dipole elements, such as, for example, dipole element 210, radiate the 1900 MHz signal. The distance between successive dipoles of the same band should be no less than ½ the wavelength (λ) and should not be greater than one λ. However, between these two extremes, the separation distance can be varied to optimize the antenna 200 for maximum performance.

The impedance of the dipoles created from dipole elements 201-206, 210-215 and 220-225 should match the impedance of free space, e.g. 377 ohms. The physical length of each dipole element 201-206, 210-215, and 220-225 is determined by the frequency that each dipole is intended to radiate. The ratio of the number of shorter dipoles to the longer dipoles is variable and depends upon the gain desired at each frequency. The number of dipoles of each type is determined by the amount of gain that is desired. For example, doubling the number of dipoles of one type results in a 3 dB signal gain at the frequency of interest.

The coaxial ground and center conductor signals received, typically via a coaxial cable, from a transmitter (not shown) are placed on respective microstrip feedlines for microstrips 230 and 232. The impedance of the feedlines 230 and 232 should match the impedance of the coaxial cable and/or other transmission medium that feeds the signal from the transmitter to the feedlines for microstrips 230 and 232. For a coaxial cable, this impedance is typically around 50 ohms. A feed structure for feeding ground and pin signals from an RF combiner can be designed to be, for example, a microstrip, a stripline, or a coax design with a single RF connector at one end of the multi-band antenna 200. The multi-band antenna 200 can also have a cylindrical radome 240 placed over the antenna structure for weather proofing.

In one modification to the multi-band antenna 200, the shorter dipoles can be laid out so that they are on both sides of the main feedlines for microstrips 230 and 232, and the longer dipoles can also be laid out so that they are on both sides of the main feedlines for microstrips 230 and 232. An example of such a modification can be achieved by replacing shorter dipole elements 210-211 and 220-221 with a single larger set of corresponding dipole elements of substantially equivalent size as dipole elements 201 and 204; replacing longer dipole elements 202 and 205 with two pairs of corresponding shorter dipole elements similar to dipole elements 214-215 and 224-225; and replacing shorter dipole elements 212-213 and 222-223 with a pair of corresponding longer dipole elements. Such a modification can provide a more omni radiation pattern.

Figure 3A:
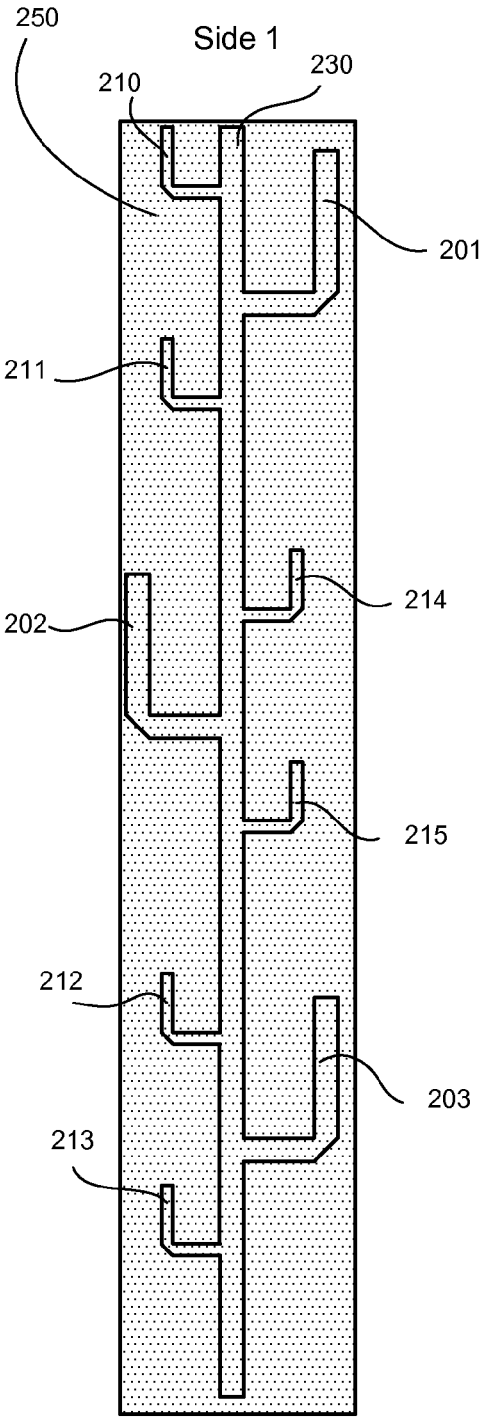
FIGS. 3A and 3B illustrate the two sides of the multi-band antenna in accordance with an aspect of an embodiment.
Figure 3B:
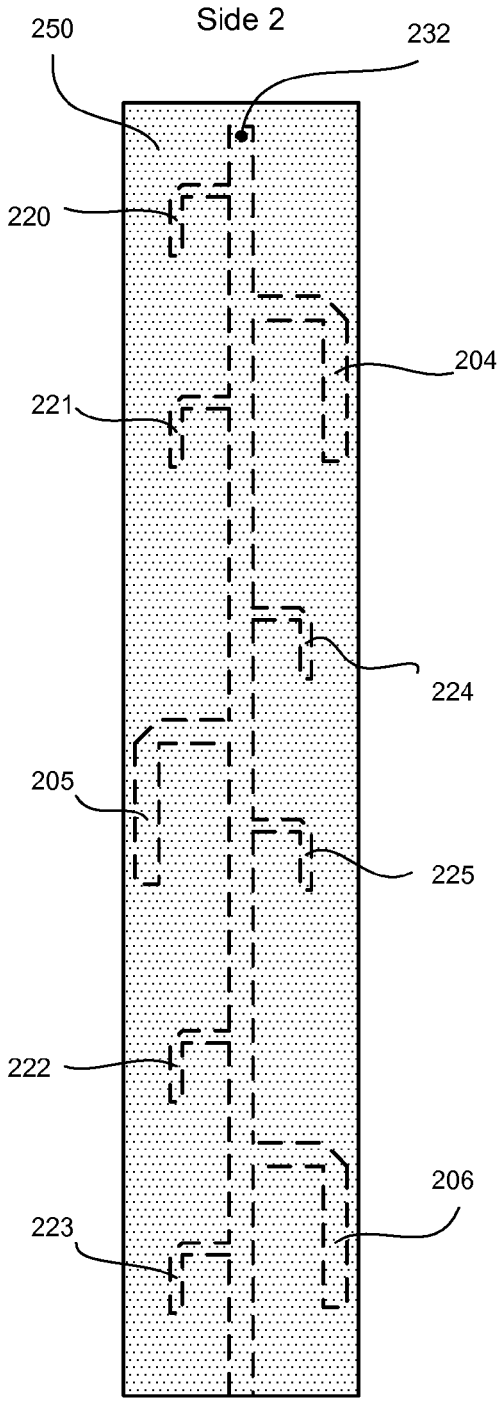

With reference to FIGS. 3A-3B, the two sides of the multi-band antenna 200 are depicted in accordance with an aspect of an embodiment. FIG. 3A depicts side 1 on the multi-band antenna 200. FIG. 3B depicts side 2 of the multi-band antenna 200. Both the views in FIG. 3A and FIG. 3B are from the same side, but represent a different cross-section of multi-band antenna 200. In between the two cross-sections shown in FIG. 3A and FIG. 3B is a layer of dielectric material 250. The pattern of the microstrips 230 and 232, and the dipole elements 201-206, 210-215, and 220-225 is etched or otherwise formed in a dielectric substrate 250 and a electrically conductive material such as, for example, copper is deposited onto each side of the dielectric substrate 250 to form the multi-band antenna 200. Alternatively, a reverse mask acid etch can be performed in order to form the appropriate pattern of feedlines and dipole elements. It can be appreciated that although only two microstrips are provided in this example, more than two microstrips can be utilized to create additional frequency bands for the multi-band antenna 200.

Figure 4:
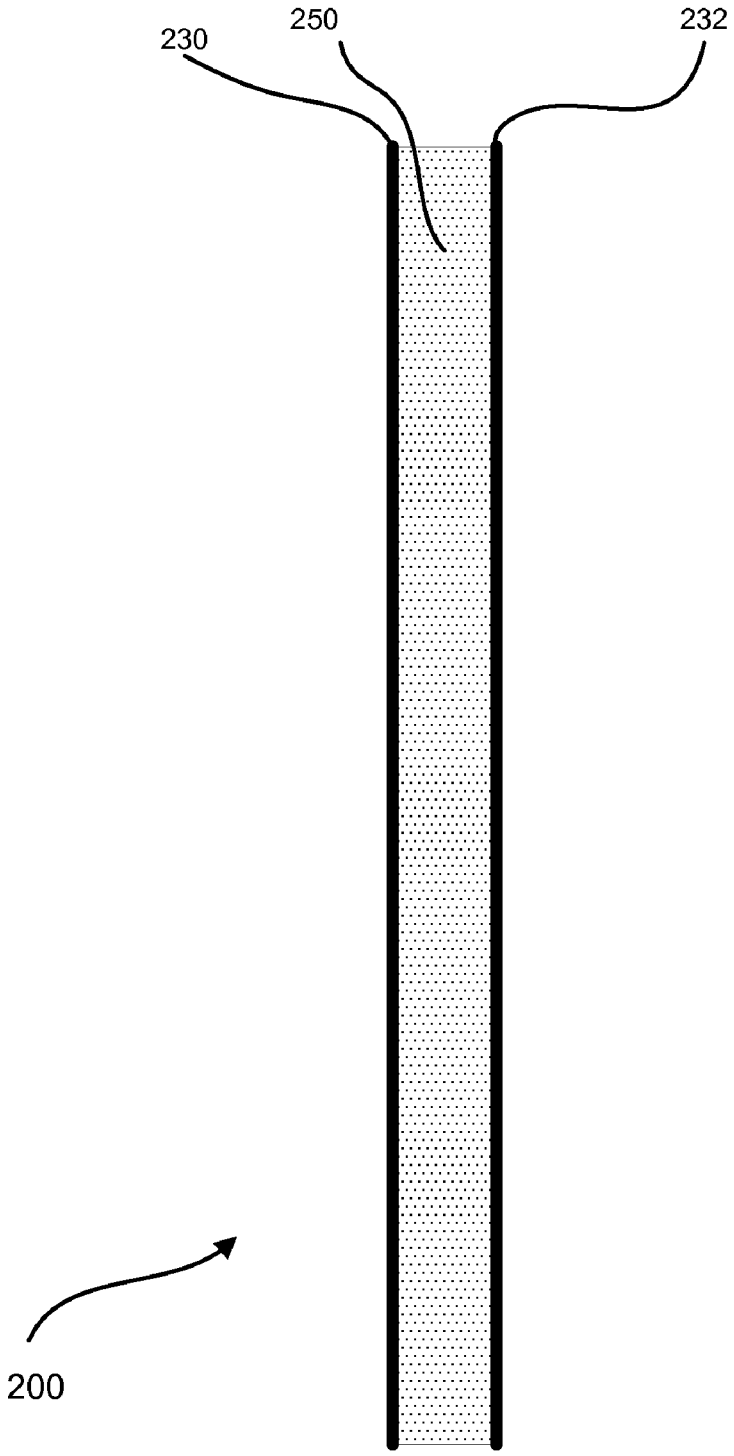
FIG. 4 is a side view of the multi-band antenna oriented ninety degrees away from the view depicted in FIG. 2 in accordance with an aspect of an embodiment.

With reference now to FIG. 4, a side view of the multi-band antenna 200 oriented ninety degrees away from the view depicted in FIG. 2 is shown in accordance with an aspect of an embodiment. In this view, it is more readily apparent that microstrips 230 and 232 as well as associated dipole elements connected to microstrips 230 and 232 are separated from each other by the dielectric material 250.

Figure 5:
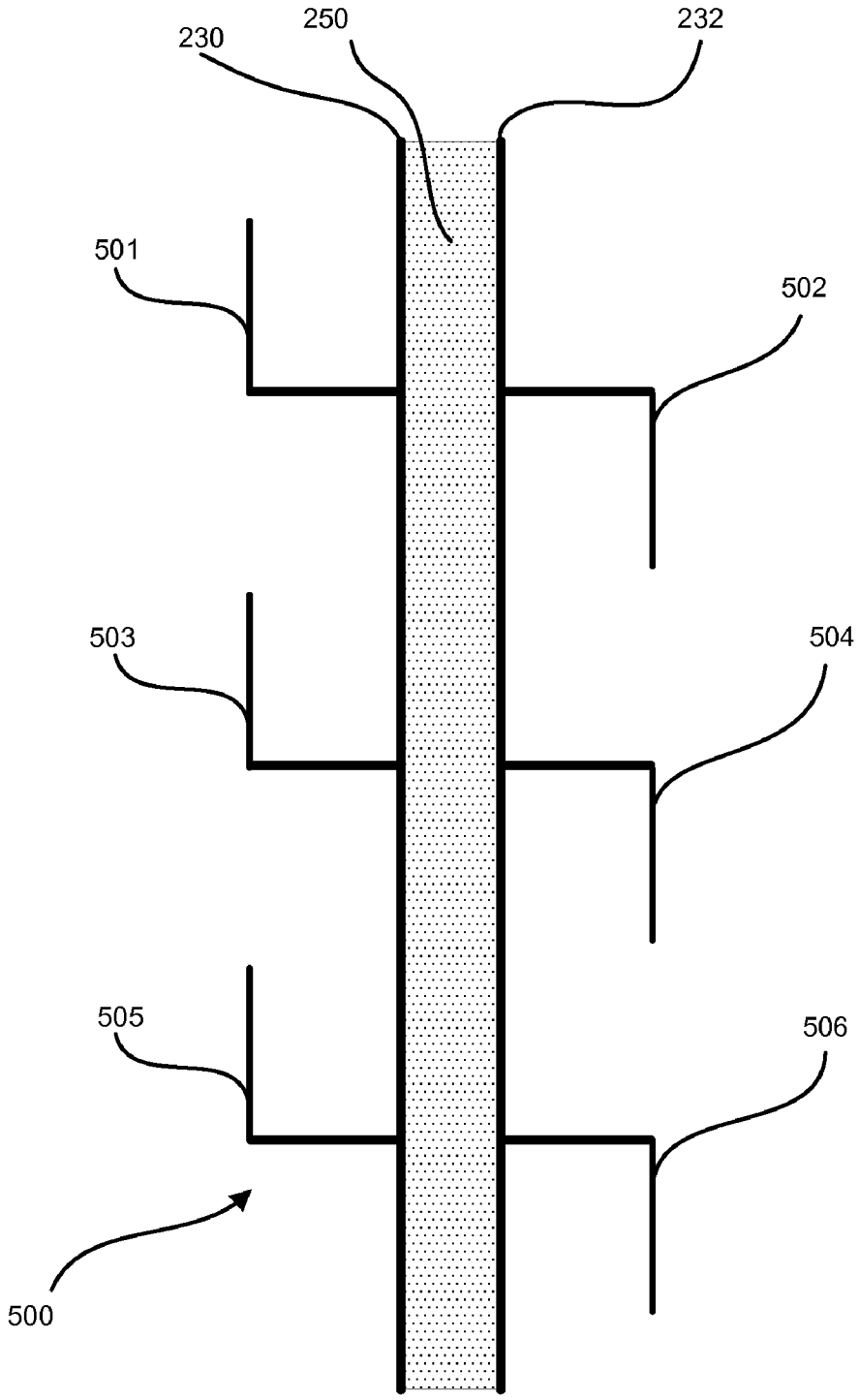
FIG. 5 is a diagram of an alternate embodiment of a dual band antenna in accordance with an aspect of an embodiment.

With reference now to FIG. 5, a diagram of an alternate construction of the multi-band antenna 200 is illustrated. Antenna 500 is similar to multi-band antenna 200 depicted in FIGS. 2-4 and is shown from the same perspective as the perspective of FIG. 4. However, dipole elements 501-506, which correspond to dipole elements 201-206 in FIGS. 2-4, have been bent away at approximately 90 degrees from the plane of a surface of the dielectric material 250 in which the microstrips 230, 232 and dipole elements 501-506 were formed. Bending dipole elements 501-506 away from the surface of the dielectric material 250 reduces the interference between the dipoles formed by dipole elements 210-213 and the dipoles formed by dipole elements 501-506.

Figure 6:
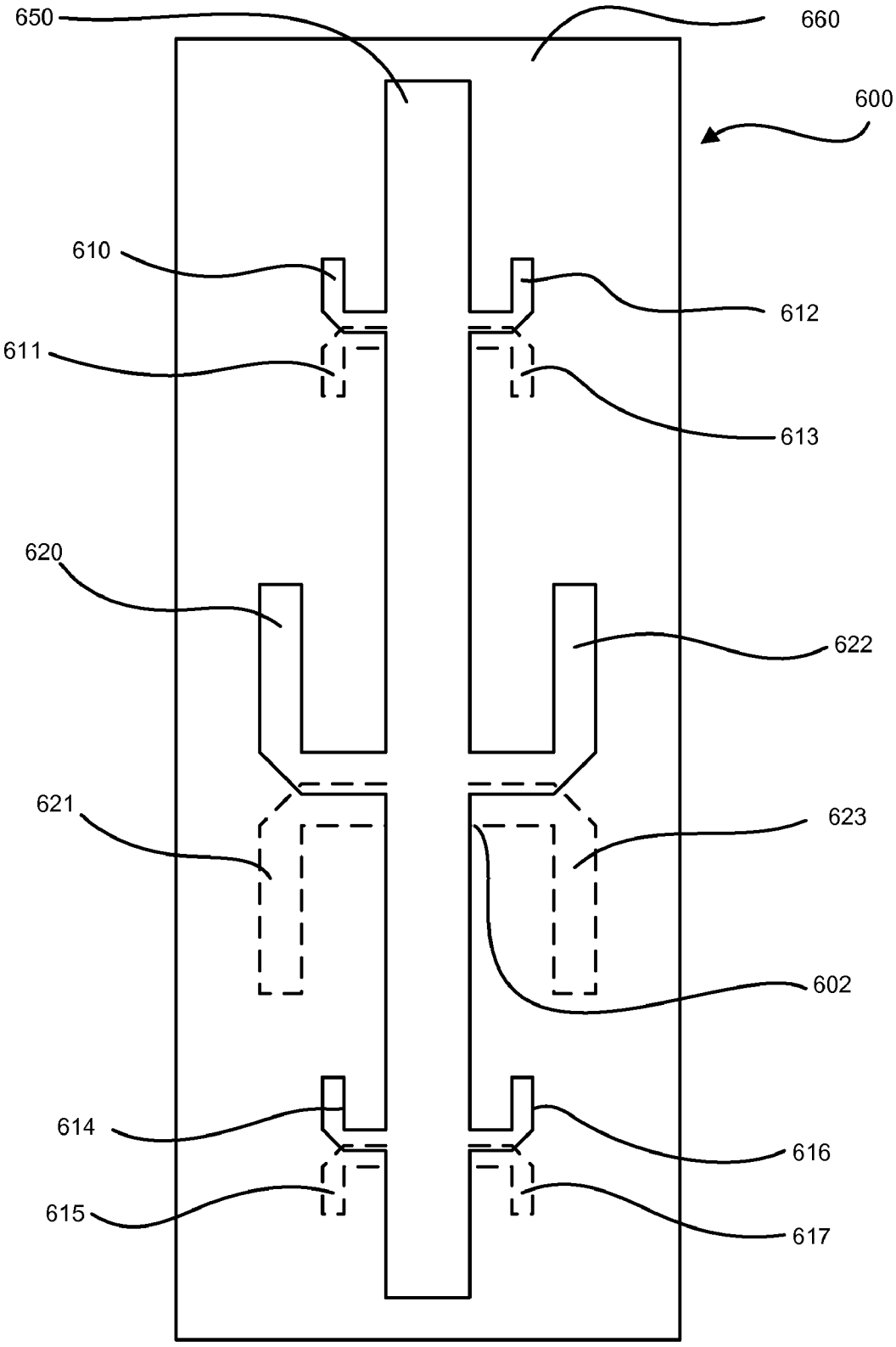
FIG. 6 is a diagram illustrating a symmetric embodiment of a multi-band antenna in accordance with an aspect of an embodiment.

With reference now to FIG. 6, a diagram illustrating a symmetric embodiment of a multi-band antenna is depicted in accordance with an aspect of an embodiment. The multi-band antenna depicted in FIG. 2 is an asymmetric configuration of a dual-band antenna. However, alternatively, a symmetric configuration of a dual-band (or higher order multi-band) antenna can be constructed. Antenna 600 is an example of a symmetric dual-band antenna. In this embodiment, the dipole elements 610-617 are arranged such that on one side of the microstrip 650 and within the plane of the microstrip 650 is a mirror image dipole element of the dipole element on the other side of the microstrip 650 and in the plane of microstrip 602 (which is beneath microstrip 650 when viewed as depicted in FIG. 6). Thus, for example, two short dipoles are formed on either side of microstrip 650 by dipole elements 610-613 (e.g., the pair of elements 610 and 611 form a dipole and the pair of elements 612 and 613 form a dipole) and two short dipoles are formed on either side of microstrip 650 by dipole elements 614-617 (e.g., the pair of dipole elements 614 and 615 form a dipole and the pair of elements 616 and 617 form a dipole). Two longer dipoles are formed by elements 620-623 (e.g. the pair of dipole elements 620 and 621 from one dipole and the pair of dipole elements 622 and 623 form a second dipole). All of the elements 602, 610-617, 620-623, and 650 are formed within a dielectric material 660. The dielectric material 660 also physically separates elements 610, 612, 614, 616, 620, 622, and 650 from elements 602, 611, 613, 615, 617, 621, and 623.

Figure 7:
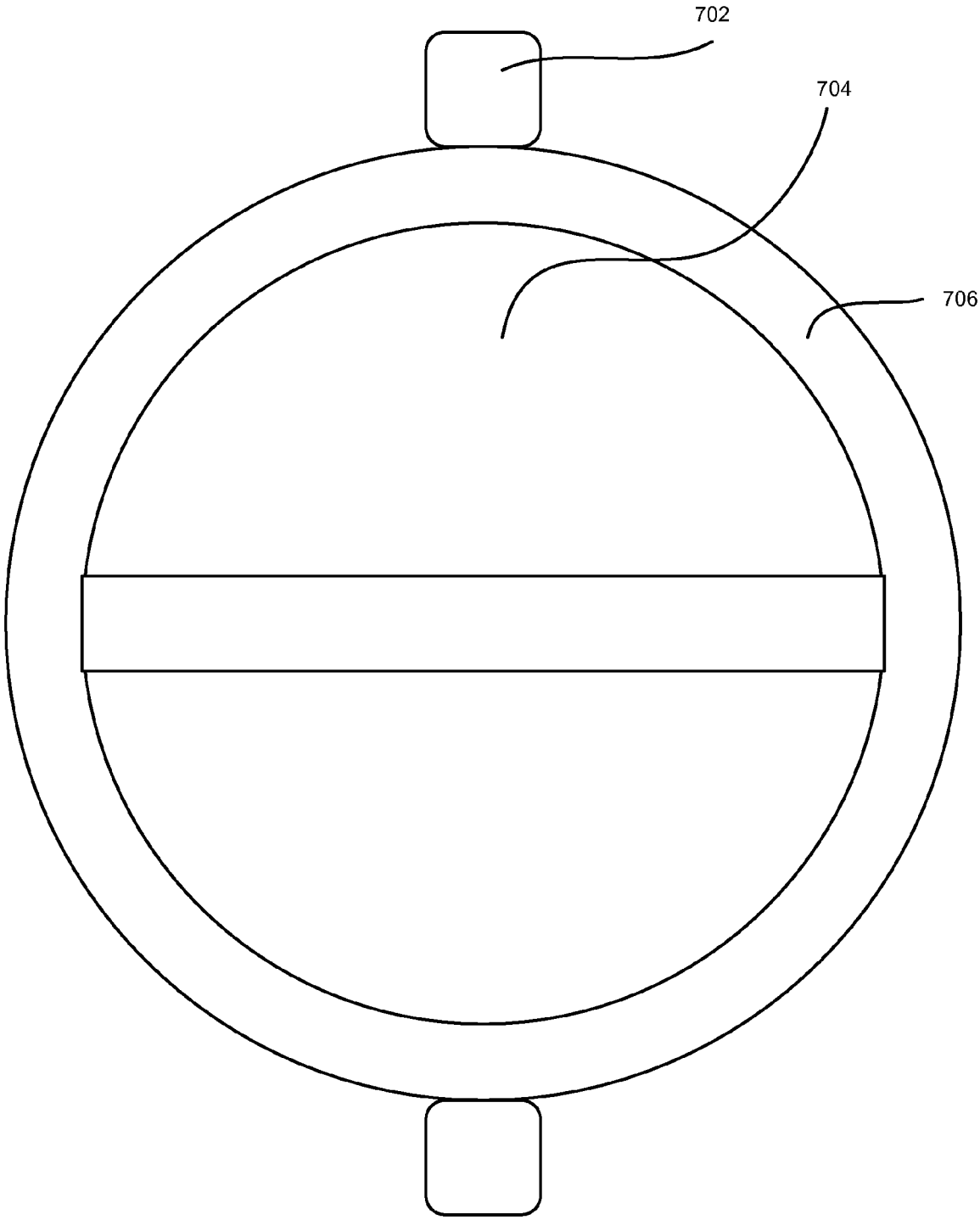
FIG. 7 is a diagram illustrating a multi-band antenna encased in a radome in accordance with an aspect of an embodiment.
Figure 8:
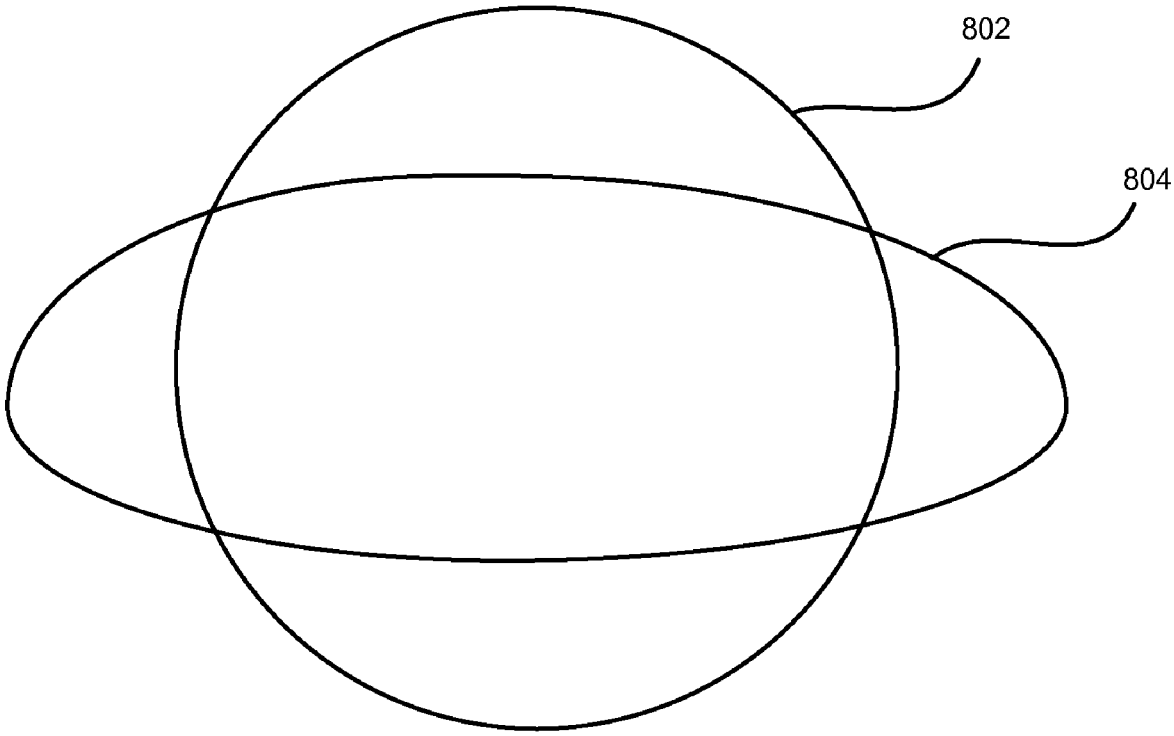
FIG. 8 is radiation patterns of a multi-band antenna with and without a parasitic element in accordance with an aspect of an embodiment.

With reference now to FIG. 7, a diagram illustrating a multi-band antenna encased in a radome is depicted in accordance with an aspect of an embodiment. Antenna 704 is a multi-band antenna such as, for example, multi-band antenna 200 in FIG. 2 and is encased within a radome 706 having a parasitic element 702 attached to the outside. Without the parasitic element 702, the radiation pattern of antenna 704 is more elliptical and similar to a radiation pattern 804 depicted in FIG. 8. However, with the addition of parasitic element 702, the radiation pattern produced by antenna 704 becomes more circular and omni-directional as depicted by radiation pattern 802 in FIG. 8.

The antennas depicted in FIGS. 2-6 are examples of multi-band antennas with dual bands. Dual-band antennas have been shown for simplicity of explanation. However, these antennas are presented and intended only as examples of a multi-band antenna and not as architectural limitations. It is appreciated that the instances presented above can be extended to antennas having three, four, or more operation bands by adding additional dipole elements of lengths corresponding to the additional bands desired.

Figure 9:
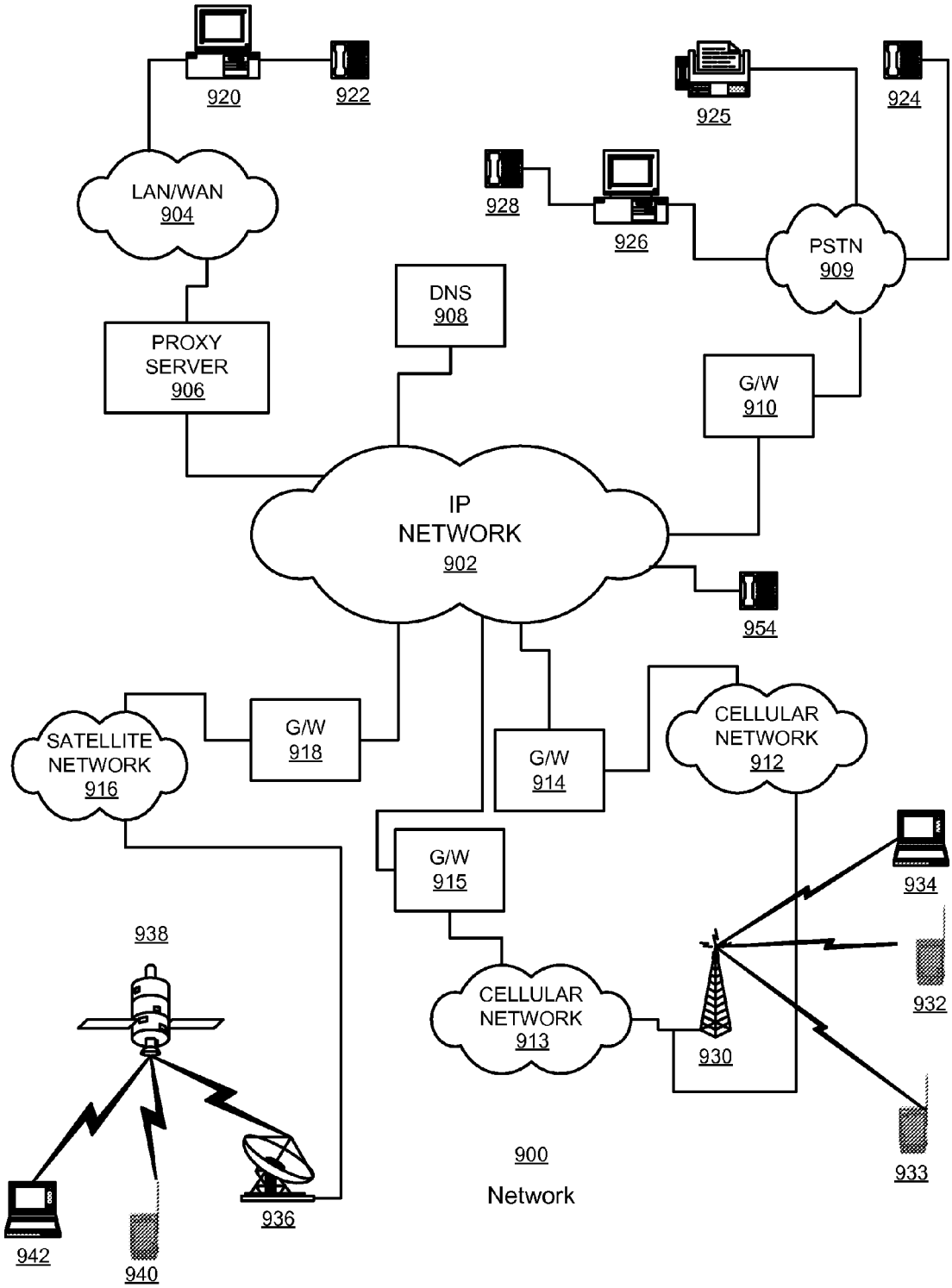
FIG. 9 is a system diagram illustrating a communication system in accordance with an aspect of an embodiment.

In order to provide additional context for implementing various aspects of the embodiments, FIG. 9 and the following discussion are intended to provide a brief, general description of a suitable communication network 900 in which the various aspects of the embodiments can be performed. It can be appreciated that the inventive structures and techniques can be practiced with other system configurations as well.

In FIG. 9, a system diagram illustrating a communications network 900 in accordance with an aspect of an embodiment is depicted. The communications network 900 is a plurality of interconnected heterogeneous networks in which instances provided herein can be implemented. As illustrated, communications network 900 contains an Internet Protocol (IP) network 902, a Local Area Network (LAN)/Wide Area Network (WAN) 904, a Public Switched Telephone Network (PSTN) 909, cellular wireless networks 912 and 913, and a satellite communication network 916. Networks 902, 904, 909, 912, 913 and 916 can include permanent connections, such as wire or fiber optic cables, and/or temporary connections made through telephone connections. Wireless connections are also viable communication means between networks.

IP network 902 can be a publicly available IP network (e.g., the Internet), a private IP network (e.g., intranet), or a combination of public and private IP networks. IP network 902 typically operates according to the Internet Protocol (IP) and routes packets among its many switches and through its many transmission paths. IP networks are generally expandable, fairly easy to use, and heavily supported. Coupled to IP network 902 is a Domain Name Server (DNS) 908 to which queries can be sent, such queries each requesting an IP address based upon a Uniform Resource Locator (URL). IP network 902 can support 32 bit IP addresses as well as 128 bit IP addresses and the like.

LAN/WAN 904 couples to IP network 902 via a proxy server 906 (or another connection). LAN/WAN 904 can operate according to various communication protocols, such as the Internet Protocol, Asynchronous Transfer Mode (ATM) protocol, or other packet switched protocols. Proxy server 906 serves to route data between IP network 902 and LAN/WAN 904. A firewall that precludes unwanted communications from entering LAN/WAN 904 can also be located at the location of proxy server 906.

Computer 920 couples to LAN/WAN 904 and supports communications with LAN/WAN 904. Computer 920 can employ the LAN/WAN 904 and proxy server 906 to communicate with other devices across IP network 902. Such communications are generally known in the art and are described further herein. Also shown, phone 922 couples to computer 920 and can be employed to initiate IP telephony communications with another phone and/or voice terminal using IP telephony. An IP phone 954 connected to IP network 902 (and/or other phone, e.g., phone 924) can communicate with phone 922 using IP telephony.

PSTN 909 is a circuit switched network that is primarily employed for voice communications, such as those enabled by a standard phone 924. However, PSTN 909 also supports the transmission of data. PSTN 909 can be connected to IP Network 902 via gateway 910. Data transmissions can be supported to a tone based terminal, such as a FAX machine 925, to a tone based modem contained in computer 926, or to another device that couples to PSTN 909 via a digital connection, such as an Integrated Services Digital Network (ISDN) line, an Asynchronous Digital Subscriber Line (ADSL), IEEE 802.16 broadband local loop, and/or another digital connection to a terminal that supports such a connection and the like. As illustrated, a voice terminal, such as phone 928, can couple to PSTN 909 via computer 926 rather than being supported directly by PSTN 909, as is the case with phone 924. Thus, computer 926 can support IP telephony with voice terminal 928, for example.

Cellular networks 912 and 913 support wireless communications with terminals operating in their service area (which can cover a city, county, state, country, etc.). Each of cellular networks 912 and 913 can operate according to a different operating standard utilizing a different frequency (e.g., 850 and 1900 MHz) as discussed in more detail below. Cellular networks 912 and 913 can include a plurality of towers, e.g. 930, that each provide wireless communications within a respective cell. At least some of the plurality of towers 930 can include a multi-band antenna allowing a single antenna to service both networks' 912 and 913 client devices. Wireless terminals that can operate in conjunction with cellular network 912 or 913 include wireless handsets 932 and 933 and wirelessly enabled laptop computers 934, for example. Wireless handsets 932 and 933 can be, for example, personal digital assistants, wireless or cellular telephones, and/or two-way pagers and operate using different wireless standards. For example, wireless handset 932 can operate via a TDMA/GSM standard and communicate with cellular network 912 while wireless handset 933 can operate via a UMTS standard and communicate with cellular network 913 Cellular networks 912 and 913 couple to IP network 902 via gateways 914 and 915 respectively.

Wireless handsets 932 and 933 and wirelessly enabled laptop computers 934 can also communicate with cellular network 912 and/or cellular network 913 using a wireless application protocol (WAP). WAP is an open, global specification that allows mobile users with wireless devices, such as, for example, mobile phones, pagers, two-way radios, smart phones, communicators, personal digital assistants, and portable laptop computers and the like, to easily access and interact with information and services almost instantly. WAP is a communications protocol and application environment and can be built on any operating system including, for example, Palm OS, EPOC, Windows CE, FLEXOS, OS/9, and JavaOS. WAP provides interoperability even between different device families.

WAP is the wireless equivalent of Hypertext Transfer Protocol (HTTP) and Hypertext Markup Language (HTML). The HTTP-like component defines the communication protocol between the handheld device and a server or gateway. This component addresses characteristics that are unique to wireless devices, such as data rate and round-trip response time. The HTML-like component, commonly known as Wireless Markup Language (WML), defines new markup and scripting languages for displaying information to and interacting with the user. This component is highly focused on the limited display size and limited input devices available on small, handheld devices.

Each of Cellular network 912 and 913 operates according to an operating standard, which can be different from each other, and which may be, for example, an analog standard (e.g., the Advanced Mobile Phone System (AMPS) standard), a code division standard (e.g., the Code Division Multiple Access (CDMA) standard), a time division standard (e.g., the Time Division Multiple Access (TDMA) standard), a frequency division standard (e.g. the Global System for Mobile Communications (GSM)), or any other appropriate wireless communication method. Independent of the standard(s) supported by cellular network 912, cellular network 912 supports voice and data communications with terminal units, e.g., 932, 933, and 934. For clarity of explanation, cellular network 912 and 913 have been shown and discussed as completely separate entities. However, in practice, they often share resources.

Satellite network 916 includes at least one satellite dish 936 that operates in conjunction with a satellite 938 to provide satellite communications with a plurality of terminals, e.g., laptop computer 942 and satellite handset 940. Satellite handset 940 could also be a two-way pager. Satellite network 916 can be serviced by one or more geosynchronous orbiting satellites, a plurality of medium earth orbit satellites, or a plurality of low earth orbit satellites. Satellite network 916 services voice and data communications and couples to IP network 902 via gateway 918.

FIG. 9 is intended as an example and not as an architectural limitation for instances disclosed herein. For example, communication network 900 can include additional servers, clients, and other devices not shown. Other interconnections are also possible. For example, if devices 932, 933, and 934 were GPS-enabled, they could interact with satellite 938 either directly or via cellular networks 912 and 913.

What has been described above includes examples of the embodiments. It is, of course, not possible to describe every conceivable combination of components or methodologies for purposes of describing the embodiments, but one of ordinary skill in the art may recognize that many further combinations and permutations of the embodiments are possible. Accordingly, the subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus that facilitates wireless communications, comprising:

an antenna that receives or transmits multiple frequency bands of radio communication signals via dual transceiver microstrips having dipoles electrically coupled thereto, the dual transceiver microstrips affixed to respective sides of a common substrate within the antenna, wherein the dipoles are attached to both sides of the respective microstrips and arranged asymmetrically along a longitudinal axis of the respective microstrips, the antenna comprising:

a first microstrip for transmitting or receiving a first frequency band;

a second microstrip for transmitting or receiving a second frequency band;

at least one first component of a first type dipole element electrically coupled to a first side of the first microstrip;

at least one first component of a second type dipole element electrically coupled to the first side of the first microstrip;

at least one second component of the first type dipole element electrically coupled to a first side of the second microstrip; and at least one second component of the second type dipole element electrically coupled to the first side of the second microstrip; wherein the first and second components of the first type dipole elements are arranged to form a first dipole that transmits or receives the first frequency band when a radio frequency signal is applied to the first and second microstrips or is received over the air; and the first and second components of the second type dipole elements are arranged to form a second dipole that transmits or receives the second frequency band when a radio frequency signal is applied to the first and second microstrips or is received over the air.

2. The apparatus of claim 1, the first and second microstrips, the first and second components of the first type dipole elements, and the first and second components of the second type dipole elements are comprised of a metal material.

3. The apparatus of claim 2, wherein the metal material is copper.

4. The apparatus of claim 1, wherein the first and second microstrips are separated by a dielectric material.

5. The apparatus of claim 4, wherein the dielectric material comprises a polytetrafluoroethylene/fiberglass composite.

6. The apparatus of claim 1, wherein the first and second microstrips have an impedance of approximately 50 ohms.

7. The apparatus of claim 1, wherein the first and second components of the first type dipole elements and the first and second components of the second type dipole elements have an impedance of approximately 377 ohms.

8. The apparatus of claim 1, further comprising:

a parasitic element coupled to one of the microstrips to facilitate omni-directional radiation emitted by the antenna.

9. The apparatus of claim 1, wherein the first and second components of the first type dipole element have a longitudinal axis that is substantially perpendicular to a plane formed by the first microstrip and the first component of the second dipole element.

10. The apparatus of claim 1, further comprising:

at least one third component of the first type dipole element electrically coupled to a second side of the first microstrip and linearly displaced along the first microstrip with respect to the at least one first component of the first type such that the first and third components of the first type are asymmetrical along the line of the first microstrip; and at least one third component of the second type dipole element electrically coupled to the second side of the first microstrip and linearly displaced along the first microstrip with respect to the at least one first component of the second type such that the first and third components of the second type are asymmetrical along the line of the first microstrip.

11. The apparatus of claim 10, further comprising:

at least a fourth component of the first type dipole element electrically coupled to the second side of the second microstrip and linearly displaced along the second microstrip with respect to the at least one second component of the first type such that the second and fourth components of the second type are asymmetrical along the line of the second microstrip; and at least a fourth component of the second type dipole element electrically coupled to the second side of the second microstrip and linearly displaced along the second microstrip with respect to the at least one second component of the second type such that the second and fourth components of the second type are asymmetrical along the line of the second microstrip.

12. A multi-band antenna, comprising:

a first electrically conductive material wherein the first electrically conductive material comprises first subcomponents of a first type dipole element and a second type dipole element; and a second electrically conductive material separated from the first electrically conductive material by a dielectric material wherein the second electrically conductive material comprises second subcomponents of the first type dipole element and the second type dipole element;

wherein the first and second subcomponents of the first type dipole element are arranged to form the first type dipole element and the first and second subcomponents of the second type dipole element are arranged to form the second type dipole element;

wherein the first subcomponents are formed on a first and second side of the first electrically conductive material such to be asymmetrical along a longitudinal axis of the first electrically conductive material; and wherein the second subcomponents are formed on a first and second side of the second electrically conductive material such to be asymmetrical along a longitudinal axis of the second electrically conductive material.

13. The multi-band antenna of claim 12, further comprising a parasitic element coupled to one of the microstrips to facilitate omni-directional radiation emitted by the antenna.

14. The multi-band antenna of claim 12, wherein the dielectric material comprises a polytetrafluoroethylene/fiberglass composite.

15. A method for fabricating a multi-band antenna, comprising:

disposing a first electrically conductive material on a first side of a dielectric material;

disposing a second electrically conductive material on an second side of the dielectric material;

electrically coupling first subcomponents of a first type dipole element and a second type dipole element to a first side and a second side of the first electrically conductive material such to be asymmetrical along a longitudinal axis of the first electrically conductive material; and electrically coupling second subcomponents of the first type dipole element and the second type dipole element to a first side and a second side of the second electrically conductive material such to be asymmetrical along a longitudinal axis of the second electrically conductive material, wherein electrically coupling the first and second subcomponents comprises arranging the first and second subcomponents of the first type dipole to form the first type dipole element and arranging the first and second subcomponents of the second type dipole element to form the second type dipole element.

16. The method of claim 15, further comprising coupling a parasitic element to at least one of the first electrically conductive material or the second electrically conductive material.

* * * * *